US006108953A

United States Patent [19]

Hall

[11] Patent Number: 6,108,953

[45] Date of Patent: Aug. 29, 2000

[54] FILE FOLDER BUSINESS CARD ORGANIZER SYSTEM

[76] Inventor: Samantha Hall, 11511 113th St. Apt. 10-G, Largo, Fla. 33772

[21] Appl. No.: 09/411,597

[22] Filed: Oct. 4, 1999

[51] Int. Cl.[7] ..... B42F 21/00

[52] U.S. Cl. ..... 40/359; 40/641; 283/36; 281/31; 407/79

[58] Field of Search ..... 40/359, 360, 641; 283/36, 37, 38, 39, 40, 41, 42; 281/31; 402/79

[56] References Cited

U.S. PATENT DOCUMENTS 1,317,265 9/1919 Bushnell ..... 40/359
2,878,814 3/1959 Consaul ..... 40/359
3,747,242 7/1973 Heimann .
5,882,038 3/1999 Ong .

*Primary Examiner*—Cassandra H. Davis
*Attorney, Agent, or Firm*—Dennis G. LaPointe; Mason & Associates, PA

[57] ABSTRACT

A file folder business card organizer system wherein a business card can be adhesively attached to the a tab portion of a file folder or alternatively, the business card can be attached by inserting the corners into diagonal slits located diagonally opposite each other. Two or four slits may be used. Other embodiments include the ability to attach business cards to the back sheet portion of the file folder by using the adhesive method or the slit method, or a combination of both. The adhesive is protected with a protective cover means, generally an impervious flexible peelable film strip or laminate that can be lifted and separated from the adhesive coating so that the back of the business card can be applied to the adhesive.

8 Claims, 8 Drawing Sheets

FILE FOLDER BUSINESS CARD ORGANIZER SYSTEM

BACKGROUND OF THE INVENTION

1. Field of the Invention

The invention relates to a tabbed file folder adapted to attach business cards as an organizer for readily identifying business entities and readily retrieving filing information provided by such business entities.

2. Description of Related Art

Index and organizational markers applied to file folders are known in the art. However, a tour of the many stationary supply stores will not provide a file folder system where a customer can apply, as a label, business cards from a supplier of a product line, and within which information about the product line can be stored and is readily available. Most prior art folders simply contain an index tab upon which a label must be attached. Information about the product or supplier must be typed or printed using a computer, on the label before it is adhesively applied to the index portion of the file folder. Other identifying accessories for file folders are plastic index markers which stick to the file folder and a label, generally wide enough to accommodate only a one line entry of data, is slid into the plastic index marker.

None of the file folders generally found in the business stationary supply stores solve the problem of organizing information about a product line with a vendor or supplier of the product line, wherein a business card can be used as a label on the file folder. For example, a medical sales representative may call on many customers, but these customers in turn meet with innumerable sales representatives on a daily basis. An enormous amount of information and literature is exchanged between the customer and the several sales representatives. Customers have been found to have a difficult time tracking the information such that when a subsequent visit is made, the customers often cannot find the previous information provided to them. Instead, previously provided information and literature is often misplaced or intermixed with competitors information, making it difficult to distinguish which product line is provided by each sales representative.

As a result, much of the information previously provided becomes wasted, along with the time spent by the sales representative in stopping by the customer's place of business to market the product line. Even if the information is still retrievable by the customer, a sales representative must often wait a significant amount of time on a subsequent visit until the customer finds the previously provided information and/or literature. If the information is not found, then valuable time is wasted as the sales representative must then repeat the sales pitch made the previous visit. Therefore, no significant sales progress is made during the sales meeting, sales are lower and the earnings of the sales representative, which are generally based on sales commissions, are also lower.

The solution is to have a simplistic file folder organizer system where the customer can keep information from one sales representative separate from other information provided by other sales representatives by using each sales representative's business card as a file folder label. With this novel system, a customer, with little effort, can attach a sales representative's business card to a file folder and insert within the file folder information about the product line for future use, thus promoting better time management between the sales representative and the customer, while improving the chances of enhancing sales. In addition, due to the layout of a traditional business card format, a labeled file folder could easily be inserted into an alphabetically organized filing drawer.

Similarly, sales representatives can use the same system by placing a customer purchasing agent's business card on a file folder and filing information regarding any submitted quotes, contract, correspondence, literature and other product line information already provided to the customer's purchasing agent, thereby providing quick access of everything a user needs to know in advance of a call or a meeting with a customer.

Without such a file folder organizer, important documents regularly become lost due to an inconsistent filing system; increased stress is experienced brought about by the inability to quickly locate information when needed; too much time is spent doing menial tasks such as trying to locate information; the quality of customer service is diminished; and the professional presentation of the information previously provided is compromised. For both the sales representative and the customer, the additional time spent at work due to the inefficiencies of current filing systems, may lead to lost personal time with families.

There are many potential users for this novel invention. Along with sales representatives and purchasing agents, consultants, business entities providing services and government agencies tracking information about specific business entities may use this invention.

SUMMARY OF THE INVENTION

The present invention is a file folder business card organizer system utilizing file folders which typically have a front sheet portion and a back sheet portion, usually made from a relatively stiff stock material, hinged together along a bottom edge of the front and back sheet portions. The back sheet portion has a top edge and an integral tab portion extending a predetermined height and width above the top edge of back sheet portion.

The invention includes means for attaching a business card to a predetermined surface area of the combined integral tab portion and back sheet portion such that at least a portion of the indicia on the business card is visible in the tab portion when the file folder is closed. In one embodiment, the means for attaching the business card includes pressure-sensitive adhesive applied over the predetermined surface area of the combined integral tab portion and back sheet portion, the adhesive being sufficient to secure the business card. It is anticipated that releasable or non-releasable pressure sensitive adhesive can be used depending on the preference of the manufacturer.

The means for attaching the business card using the adhesive embodiment further includes a protective cover means for protecting the pressure-sensitive adhesive and for preventing the premature exposure of the adhesive. The protective cover means is peelable from the adhesive so that the business card can be attached directly to the adhesive.

The above described embodiment optionally includes means for attaching additional business cards to predetermined surface areas of the back sheet portion. The means for attaching additional business cards includes pressure-sensitive adhesive applied over each of the predetermined surface areas of the back sheet portion, the adhesive being sufficient to attach or secure each of the additional business cards. Each of the means for attaching the additional business cards further includes a protective cover means for protecting the pressure-sensitive adhesive and for preventing the premature exposure of the adhesive, the protective cover means being peelable from the adhesive so that each of the business cards can be attached directly to the adhesive.

One alternative embodiment incorporating the adhesive method of attaching the business card to the tab portion of the file folder also includes means for attaching additional business cards to predetermined surface areas of the back sheet portion. However, in this embodiment, the means includes at least two opposite diagonal slits, preferably four slits, adapted to insert diagonally opposite corners of each additional business card. Optionally, four slits may be used to accept the four corners of the business card. Although three diagonal slits may be used, there would appear to be little or no advantage to the third slit. It is anticipated that either two or four opposite diagonal slits would be the most practical application of the present invention.

In the embodiment incorporating the adhesive method of placing a business card to both the tab portion area and the back sheet portion, means for attaching additional business cards to predetermined surface areas of the back sheet portion, which include at least two opposite diagonal slits adapted to insert diagonally opposite corners of each additional business card, may be added.

In another embodiment of the present invention, the file folder business card organizer system includes a file folder, as described above, and means for attaching a business card to a predetermined surface area of the combined integral tab portion and back sheet portion; however, the means includes at least two opposite diagonal slits adapted to insert diagonally opposite corners of the business card. This particular embodiment may optionally further include means for attaching additional business cards to predetermined surface areas of the back sheet portion, the means in this embodiment, including at least two opposite diagonal slits adapted to insert diagonally opposite corners of each additional business card. As noted above, four slits may be used to accept the four corners of each business card. Alternatively, it may include, as means for attaching additional business cards to predetermined surface areas of the back sheet portion, pressure-sensitive adhesive applied over each of the predetermined surface areas of the back sheet portion, the adhesive being sufficient to secure the additional business cards. This embodiment would also include the protective cover means for protecting the pressure-sensitive adhesive and for preventing the premature exposure of the adhesive, the protective cover means being peelable from the adhesive so that each of the business cards can be attached directly to the adhesive. Again optionally, a combination of the adhesive method and corner slit method may be used to place additional business cards on the back sheet portion along with the use of the corner slit method on the tab portion of the back sheet portion. These additional attachment sites will allow a user to keep track of more than one business card from the same entity while minimizing the likelihood of a business card falling out of the file folder.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
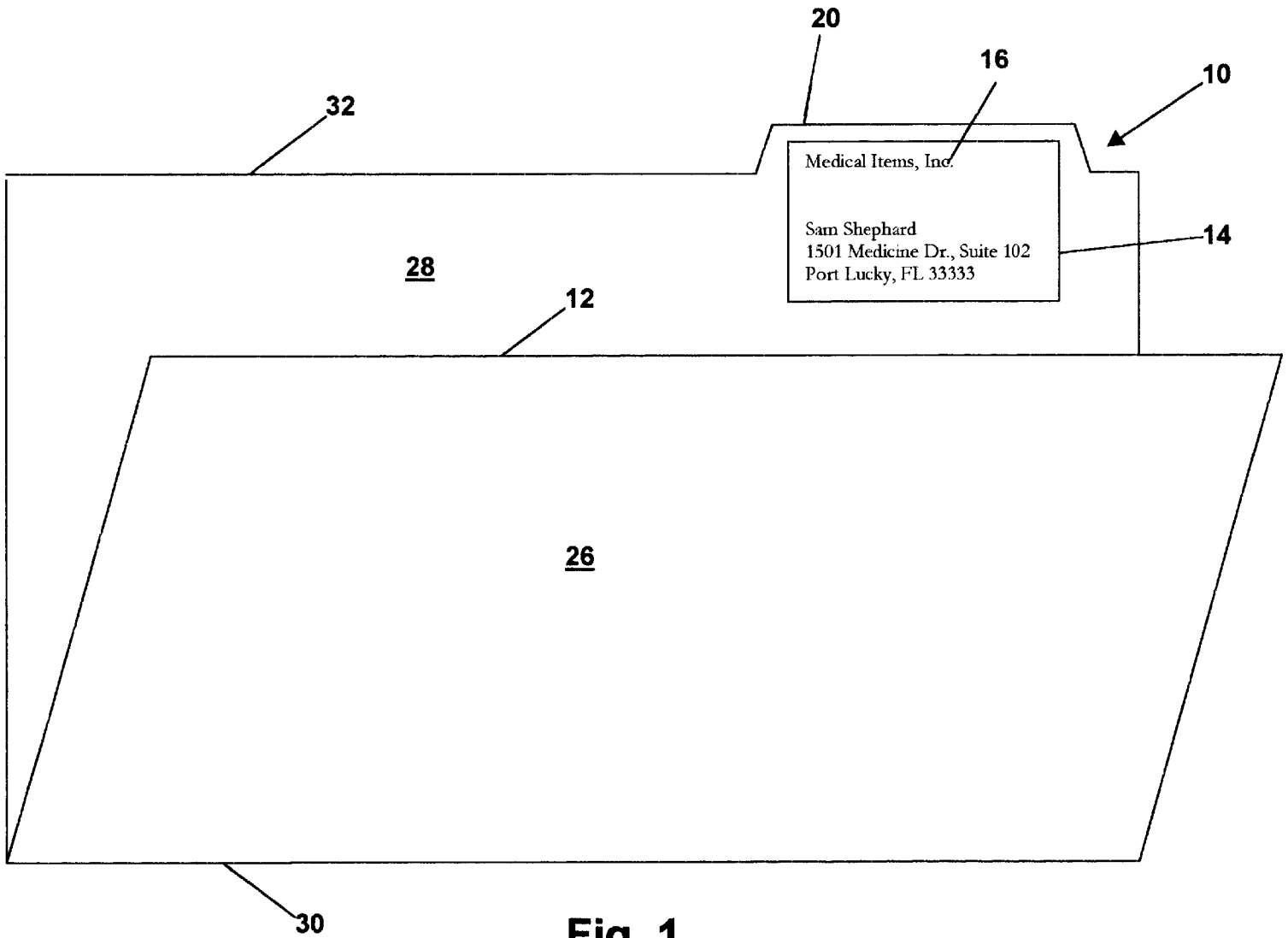
FIG. 1 is a view of a partially opened file folder with an attached business card.

Referring now to the drawings, in particular FIG. 1, the invention which is a file folder business card organizer system depicted generally as 10, comprises a file folder 12 which typically has a front sheet portion 26 and a back sheet portion 28, usually made from a relatively stiff stock material, hinged together along a bottom edge 30 of the front and back sheet portions, 26 and 28 respectively. The back sheet portion 28 has a top edge 32 and an integral tab portion 20 extending a predetermined height and width above the top edge 32 of back sheet portion 28.

Figure 2:
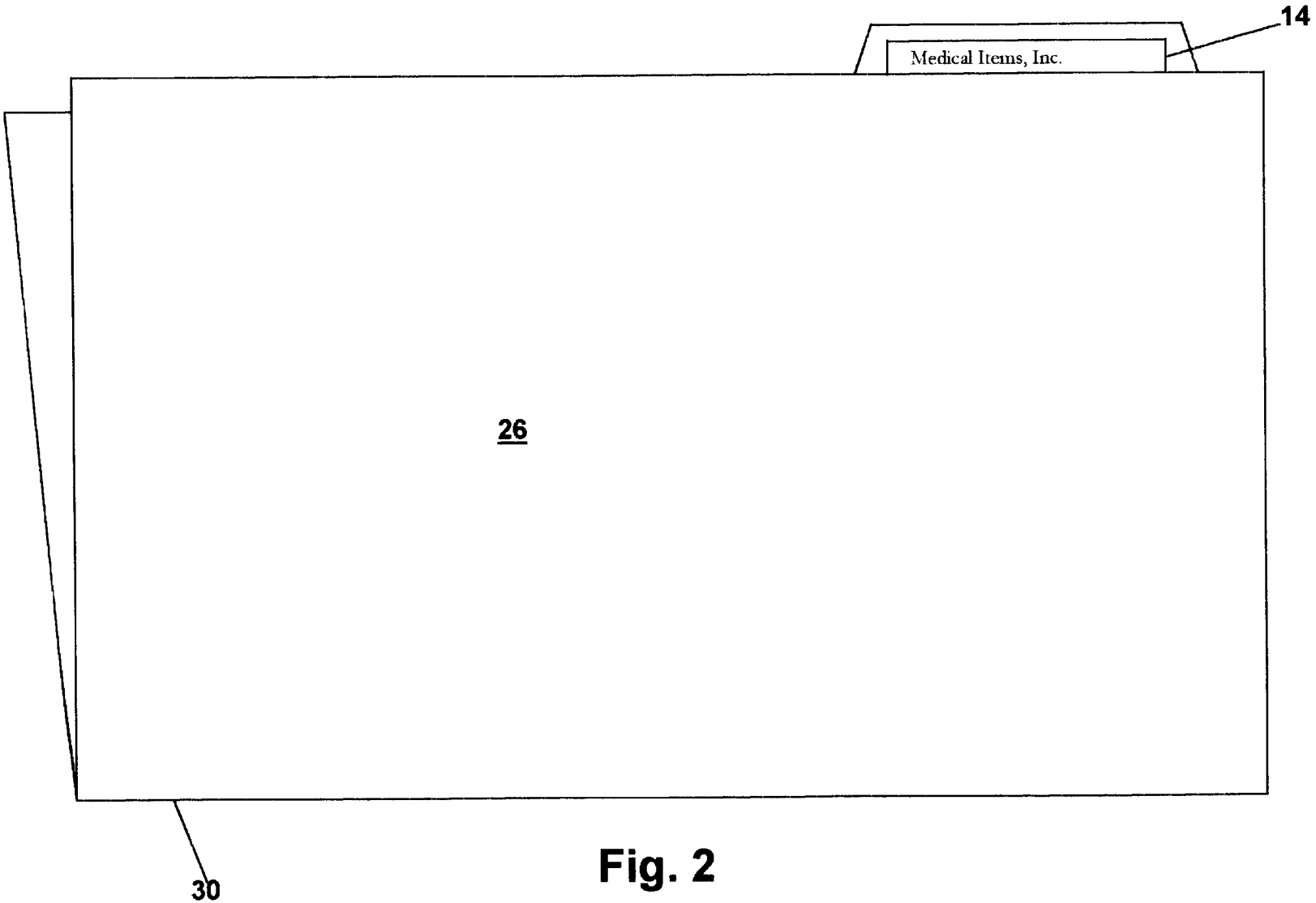
FIG. 2 is a view of the file folder of FIG. 1 in an almost closed position.
Figure 3:
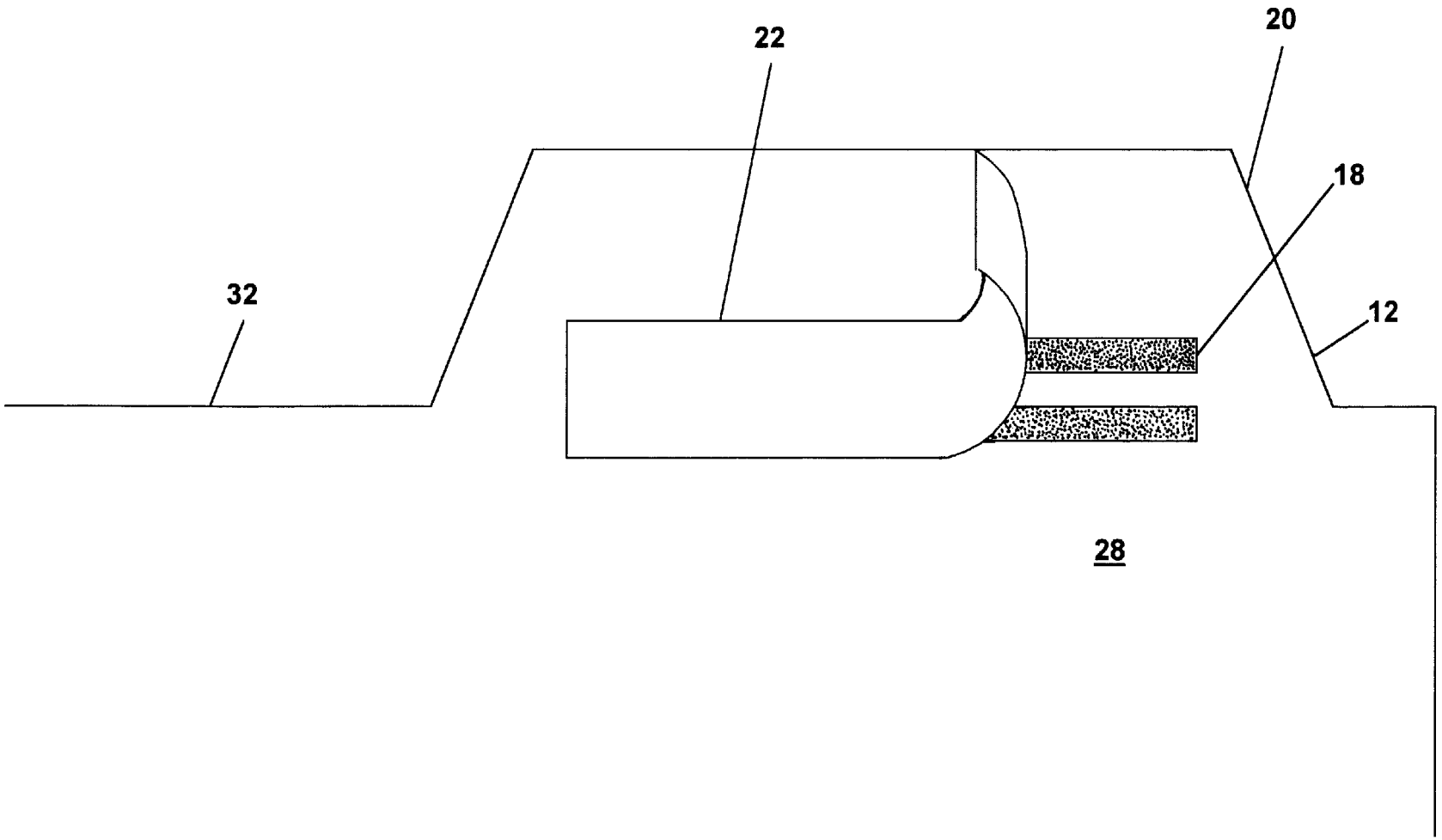
FIG. 3 is a view of the tab portion of the file folder depicting the adhesive attachment means for the business card.

The invention includes means for attaching a business card 14 to a predetermined surface area of the combined integral tab portion 20 and back sheet portion 28 such that at least a portion of the indicia 16 on the business card 14 is visible in the tab portion 20 when the file folder 12 is closed, as shown in FIG. 2. In one embodiment shown in FIG. 3, the means for attaching the business card 14 includes pressure-sensitive adhesive 18 applied over the predetermined surface area of the combined integral tab portion 20 and back sheet portion 28, the adhesive 18 being sufficient to secure the business card 14. Such pressure-sensitive release adhesives are generally known in the art and generally commercially available and may be releasable or non-releasable pressure sensitive adhesives. Although not limited to these examples, pressure-sensitive rubber based or acrylic based adhesives may be used. The typical practical application area of the adhesive is from 20 percent to 95 percent of the underlying area upon which the business card 14 is to be attached. The adhesive 18 may be spread into a variety of patterns including linear patterns, parallel or non-parallel, or generally spread over the designated surface area of the file folder 12.

The means for attaching the business card 14 using the adhesive 18 embodiment further includes a protective cover means 22 for protecting the pressure-sensitive adhesive 18 and for preventing the premature exposure of the adhesive 18. The protective cover means 22 is peelable from the adhesive layer 18 so that the business card 14 can be attached directly to the adhesive 18. The protective cover means 22 is typically slightly larger, or at least a portion or an end of the protective cover means 22 is slightly larger, than the surface area of the adhesive layer 18 such that a slight extended portion of the protective cover means 22 can be grabbed to lift and separate the protective cover means 22 from the adhesive 18. The protective cover means 22 is typically made from flexible material formed into a film laminate, which is impervious to moisture and gases, and includes several commercially available materials such as, but not limited to, polyethylene, polyester, co-polyesters, paper, silicone coated paper, metallic foil, polystyrene and nylon.

Figure 6:
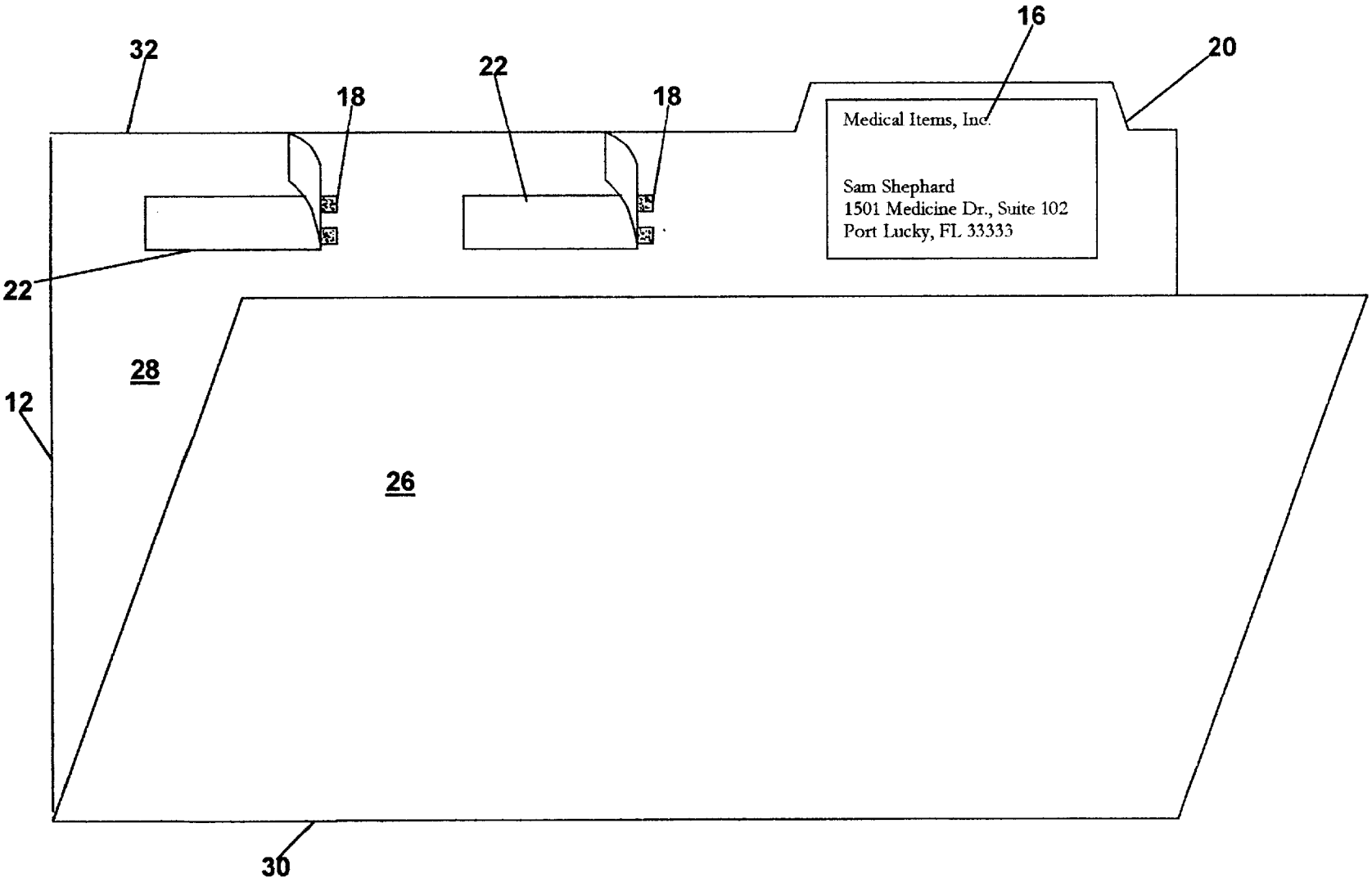
FIG. 6 is a view of a file folder depicting multiple business card adhesive attachment locations.

As shown in FIG. 6, the above described embodiment optionally includes means for attaching additional business cards 14 to predetermined surface areas of the back sheet portion 28. The means for attaching additional business cards 14 includes pressure-sensitive adhesive 18 applied over each of the predetermined surface areas of the back sheet portion 28, the adhesive 18 being sufficient to attach or secure each of the additional business cards 14. Each of the means for attaching the additional business cards 14 further includes a protective cover means 22 for protecting the pressure-sensitive adhesive 18 and for preventing the premature exposure of the adhesive 18, the protective cover means 22 being peelable from the adhesive 18 so that each of the business cards 14 can be attached directly to the adhesive 18.

One alternative embodiment incorporating the adhesive method of attaching the business card 14 to the tab portion 20 of the file folder 12 includes another means for attaching additional business cards 14 to predetermined surface areas of the back sheet portion 28. However as generally shown in FIGS. 4–5 and 7–8, in this embodiment, the means includes at least two opposite diagonal slits 24 adapted to insert diagonally opposite corners of each additional business card 14. Four slits 24 may optionally be used to accept the four corners of the business cards 14 has depicted in the FIG. 7 tab portion.

Figure 8:
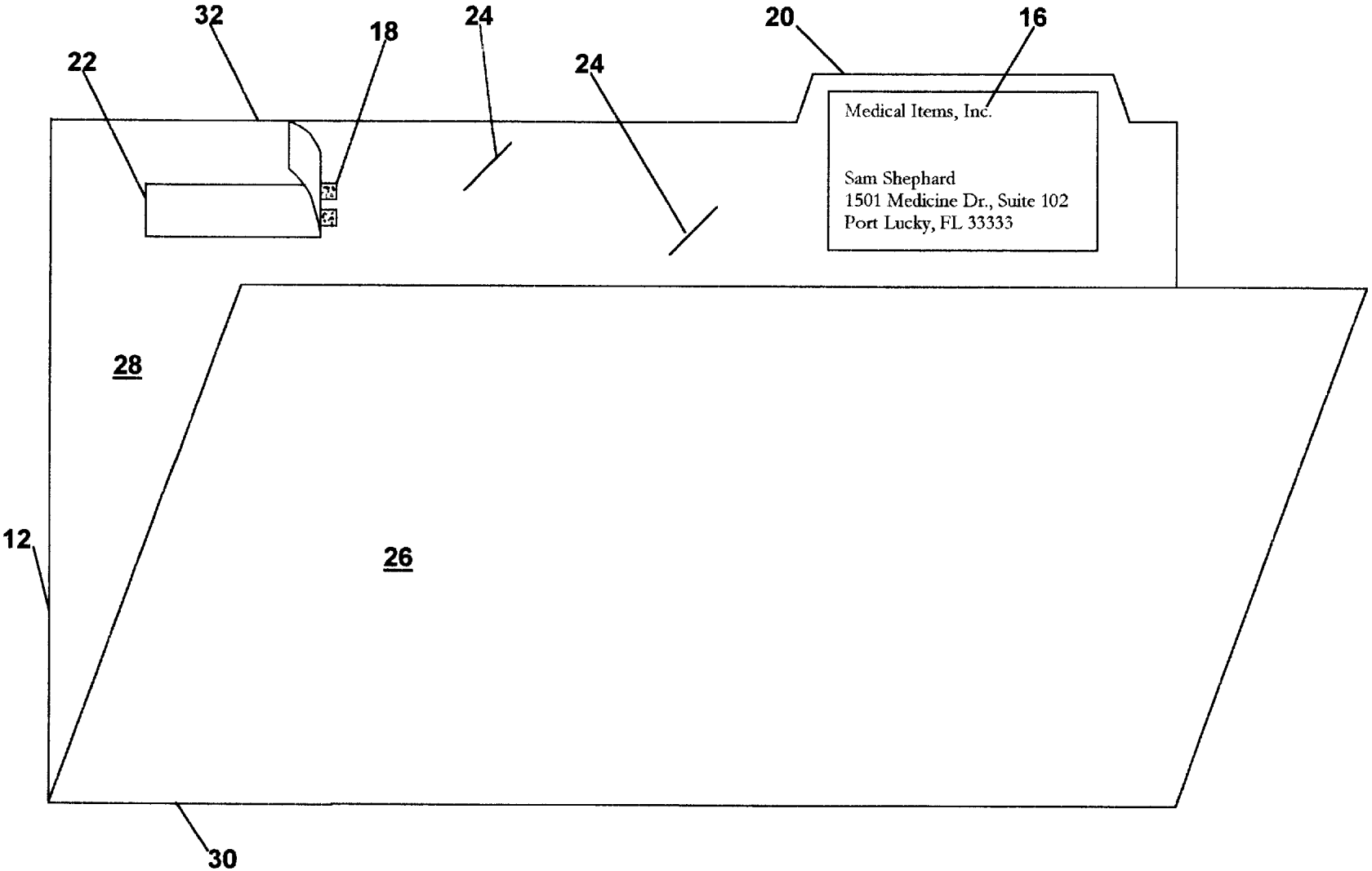
FIG. 8 is a view of a file folder depicting multiple business card attachment locations using a combination of slits and adhesive.

In the embodiment incorporating the adhesive method of placing a business card 14 to both the tab portion 20 area and the back sheet portion 28, means for attaching additional business cards 14 to predetermined surface areas of the back sheet portion 28, which include at least two opposite diagonal slits 24 adapted to insert opposite corners of each additional business card 14, may be added, as depicted in FIG. 8. Again, four slits 24 may be optionally included to accommodate each corner of each business card 14.

Figure 4:
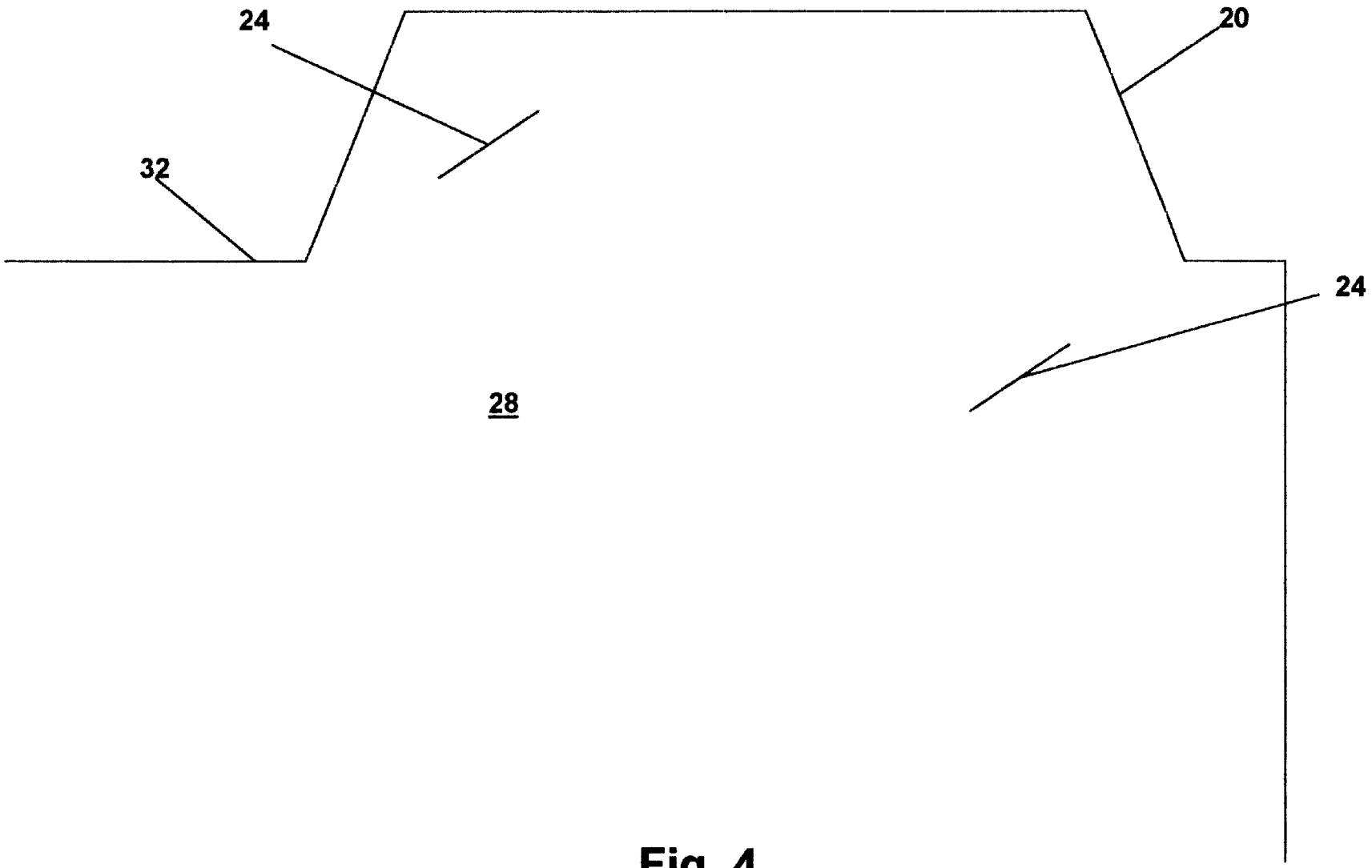
FIG. 4 is a view of the tab portion of the file folder depicting the slit attachment means for the business card.
Figure 5:
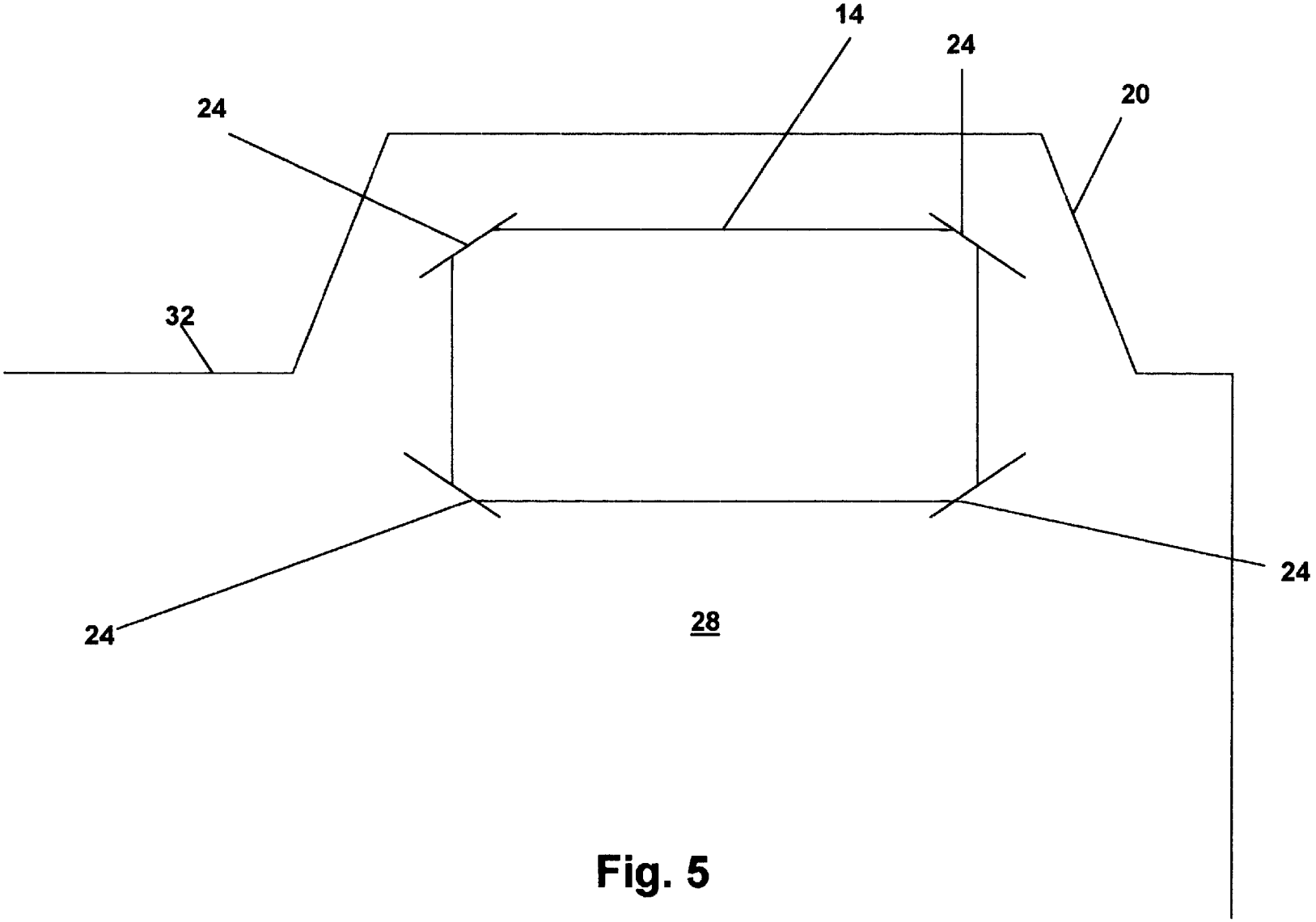
FIG. 5 is a view of the tab portion of the file folder depicting a business card inserted into the slit attachment means.
Figure 7:
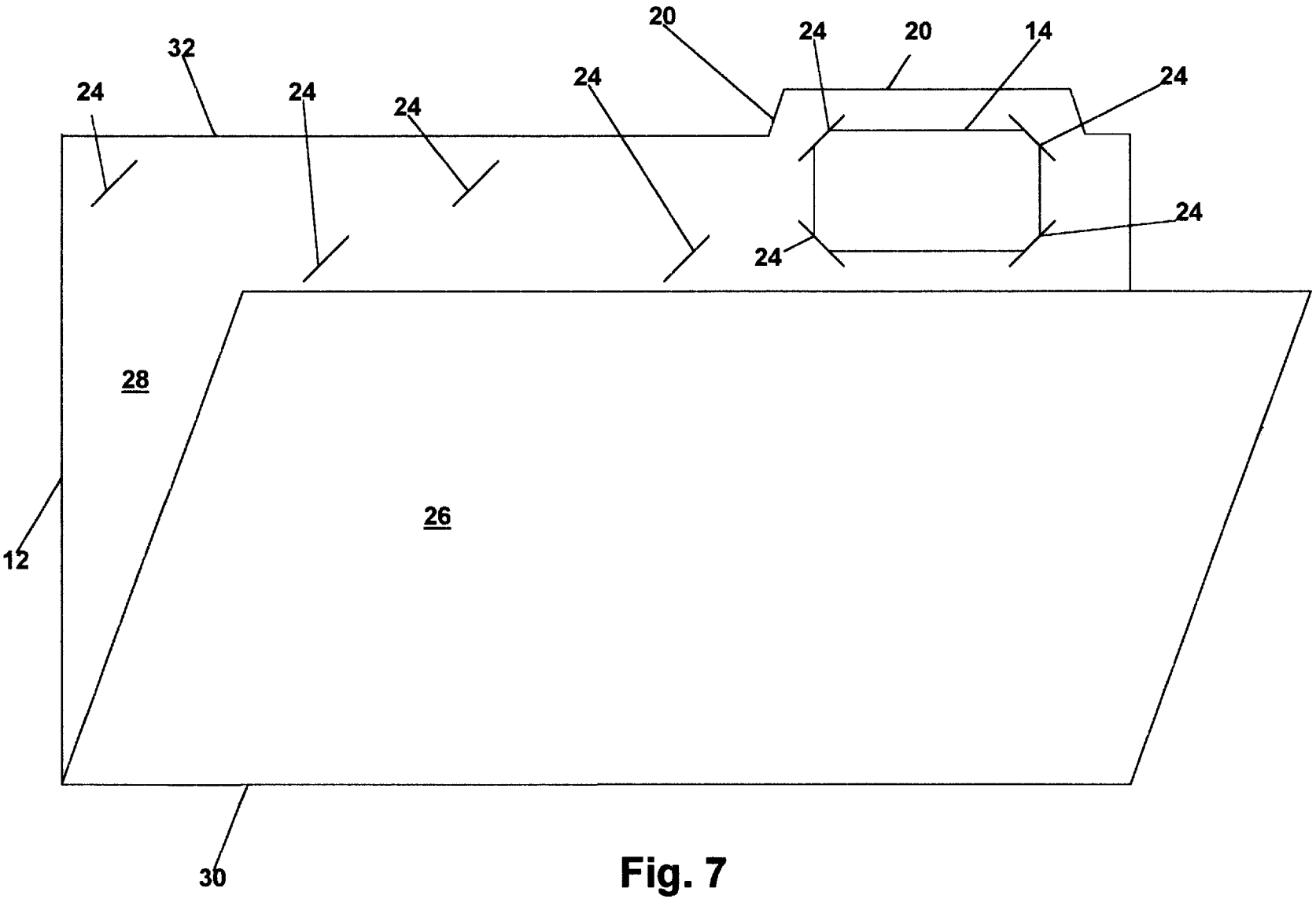
FIG. 7 is a view of a file folder depicting multiple business card attachment locations using slits.

In another embodiment of the present invention depicted in FIGS. 4–5, the file folder business card organizer system 10 includes a file folder 12, as described above, and means for attaching a business card 14 to a predetermined surface area of the combined integral tab portion 20 and back sheet portion 28; however, the means includes at least two opposite diagonal slits 24 adapted to insert diagonally opposite corners of the business card 14. As depicted in FIG. 7, this particular embodiment may optionally further include means for attaching additional business cards 14 to predetermined surface areas of the back sheet portion 28, the means in this embodiment, including at least two opposite diagonal slits 24 adapted to insert diagonally opposite corners of each additional business card 14. As noted above, four slits 24 for each business card 14 may optionally be used. Alternatively, it may include, as means for attaching additional business cards 14 to predetermined surface areas of the back sheet portion 28, pressure-sensitive adhesive 18 applied over each of the predetermined surface areas of the back sheet portion 28, the adhesive 18 being sufficient to secure the additional business cards 14. This embodiment would also include the protective cover means 22 for protecting the pressure-sensitive adhesive 18 and for preventing the premature exposure of the adhesive 18, the protective cover means 22 being peelable from the adhesive 18 so that each of the business cards 14 can be attached directly to the adhesive 18. Again optionally, a combination of the adhesive method and corner slit method may be used to place additional business cards 14 on the back sheet portion 28 along with the use of the corner slit method on the tab portion 20 of the back sheet portion 28.

As seen from the foregoing description, the present invention satisfies a long felt need to provide a file folder organizer system incorporating business cards as a way of easily storing and categorizing information by customer or vendor categories or other similar categorizations, thereby providing valuable time management cost savings in the sales related industries.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A file folder business card organizer system comprising:

a file folder having a front sheet portion and a back sheet portion hinged together along a bottom edge of the front and back sheet portions, the back sheet portion having a top edge and an integral tab portion extending a predetermined height and width above the top edge of back sheet portion;

means for attaching a business card to a predetermined surface area of the combined integral tab portion and back sheet portion, the means including pressure-sensitive adhesive applied over the predetermined surface area of the combined integral tab portion and back sheet portion, the adhesive being sufficient to secure the business card; and the means for attaching the business card further including a protective cover means for protecting the pressure-sensitive adhesive and for preventing the premature exposure of the adhesive, the protective cover means being peelable from the adhesive so that the business card can be attached directly to the adhesive.

2. The file folder business card organizer system according to claim 1 further comprising:

means for attaching additional business cards to predetermined surface areas of the back sheet portion, the means for attaching additional business cards including a second pressure-sensitive adhesive applied over each of the predetermined surface areas of the back sheet portion, the second adhesive being sufficient to secure the additional business cards; and each of the means for attaching the additional business cards further including a second protective cover means for protecting the second pressure-sensitive adhesive and for preventing the premature exposure of the second adhesive, the second protective cover means being peelable from the second adhesive so that each of the business cards can be attached directly to the second adhesive.

3. The file folder business card organizer system according to claim 2 further comprising:

second means for attaching additional business cards to the predetermined surface areas of the back sheet portion, the second means including at least two opposite diagonal slits adapted to insert diagonally opposite corners of each additional business card.

4. The file folder business card organizer system according to claim 1 further comprising:

means for attaching additional business cards to predetermined surface areas of the back sheet portion, the means for attaching additional business cards including at least two opposite diagonal slits adapted to insert diagonally opposite corners of each additional business card.

5. A file folder business card organizer system comprising:

a file folder having a front sheet portion and a back sheet portion hinged together along a bottom edge of the front and back sheet portions, the back sheet portion having a top edge and an integral tab portion extending a predetermined height and width above the top edge of back sheet portion; and means for attaching a business card to a predetermined surface area of the combined integral tab portion and back sheet portion, the means including at least two opposite diagonal slits adapted to insert diagonally opposite corners of the business card.

6. The file folder business card organizer system according to claim 5 further comprising:

means for attaching additional business cards to predetermined surface areas of the back sheet portion, the means for attaching additional business cards including at least two opposite diagonal slits adapted to insert diagonally opposite corners of each additional business card.

7. The file folder business card organizer system according to claim 6 further comprising:

second means for attaching additional business cards to the predetermined surface areas of the back sheet portion, the second means including pressure-sensitive adhesive applied over each of the predetermined surface areas of the back sheet portion, the adhesive being sufficient to secure the additional business cards; and each of the second means for attaching the additional business cards further including a protective cover means for protecting the pressure-sensitive adhesive and for preventing the premature exposure of the adhesive, the protective cover means being peelable from the adhesive so that each of the business cards can be attached directly to the adhesive.

8. The file folder business card organizer system according to claim 5 further comprising:

means for attaching additional business cards to predetermined surface areas of the back sheet portion, the means for attaching additional business cards including pressure-sensitive adhesive applied over each of the predetermined surface areas of the back sheet portion, the adhesive being sufficient to secure the additional business cards; and each of the means for attaching the additional business cards further including a protective cover means for protecting the pressure-sensitive adhesive and for preventing the premature exposure of the adhesive, the protective cover means being peelable from the adhesive so that each of the business cards can be attached directly to the adhesive.

* * * * *